United States Patent [19]

Mueller et al.

[11] 4,349,396

[45] Sep. 14, 1982

[54] METAL-CUTTING PYROTECHNIC COMPOSITION

[75] Inventors: Kurt F. Mueller; Marguerite S. Chang, both of Oxon Hill; Robert F. Farncomb, Accokeek; Lyle O. Malotky, Oxon Hill, all of Md.

[73] Assignee: The United Stated of America as represented by the Secretary of the Navy, Washington, D.C.

[21] Appl. No.: 189,410

[22] Filed: Sep. 22, 1980

[51] Int. Cl.[3] ..... C06B 45/10

[52] U.S. Cl. ..... 149/19.3; 149/44

[58] Field of Search ..... 149/19.3, 44, 37

[56] References Cited

U.S. PATENT DOCUMENTS

| | | | |
|---|---|---|---|
| 2,885,277 | 5/1959 | Fitzpatrick | 149/37 |
| 3,046,728 | 7/1962 | Fitzpatrick | 149/37 |

*Primary Examiner*—Stephen J. Lechert, Jr.

*Attorney, Agent, or Firm*—R. S. Sciascia; A. L. Branning; T. E. McDonnell

[57] ABSTRACT

A pyrotechnic composition, suitable for metal cutting, comprises an oxidizer selected from the class consisting of calcium sulfate hemihydrate, anhydrous calcium sulfate, magnesium monohydrate, anhydrous magnesium sulfate, anhydrous strontium sulfate, and mixtures thereof; a metal fuel, a halopolymeric binder; and sulfur.

14 Claims, No Drawings

METAL-CUTTING PYROTECHNIC COMPOSITION

BACKGROUND OF THE INVENTION

The invention pertains generally to pyrotechnic compositions and particularly to metal-cutting pyrotechnic compositions.

Pyrotechnic compositions are placed in metal cutting torches and are then used in salvaging and demilitarizing ordnance. The object is to develop one or more exothermic reactions among the ingredients in order to melt an area on a work piece and preferably initiate an exothermic combustion of a metallic component of the work piece.

It is necessary for a composition to quickly generate a large amount of heat per unit volume of composition without generating an appreciable amount of gas. These requirements are especially critical in the demilitarizing ordnance. If a warhead casing is not breached before the charge begins to react, a detonation often results. If a large volume of gas is generated, the torch can break contact with the work piece, thereby reducing the chances of breaching the casing before initiating the charge reaction. Further, gas generation, as an incident of oxygen reactions, absorbs the heat of reaction and removes it from the reaction system.

Cutting torches are often stored for long periods of time. Consequently, pyrotechnic compositions must be stable; so that, the cutting torch does not detonate or burn too slowly and has a predictable burning behavior. Also it is advantageous that the composition is hard to ignite for safety reasons.

Many exothermic reactions have been utilized in formulating pyrotechnic compositions, including the reactions of oxygen with a metal, fluorine and other halogens with a metal, aluminum with iron oxide, and sulfur with iron. For example, U.S. Pat. No. 3,565,706 by H. R. Waite, issued on Feb. 23, 1971, utilizes the exothermic reaction of metals with oxygen or fluorine. The composition comprises a metal fuel selected from the group consisting of IIIb, IVb, Vb metals and an oxidizing binder comprising at least 50% of a fluorohydrocarbon. This composition is used primarily in incendiary bombs. As such, gas generation and the expense of the metal fuel are not as critical as they are in compounding metal cutting pyrotechnic compositions. A mixture of iron and sulfur in U.S. Pat. No. 1,035,202 by Albert Lang, issued on Aug. 13, 1912, is disclosed as a pyrotechnic composition but the composition is not suitable for most metal cutting applications, especially ordnance demilitarization because of a lack of mechanical strength in a pellet or disc of the composition, the relatively low heat production per unit volume of composition, and the large amount of obnoxious sulfur oxide fumes.

The advantages of a fluorocarbon polymeric material as a binder and source of fluorine for oxidation, as well as, the large amount of heat released upon oxidation of magnesium, are disclosed in U.S. Pat. No. 4,013,491 by Graham C. Shaw and Russell Reed, Jr., issued on Mar. 22, 1977. The incendiary composition consists essentially of particulate magnesium and a mono- or difluoroalkyl phosphate ester. The disadvantages of this composition are a short pot life, aging problems, and poor homogeneity. In U.S. Pat. No. 3,890,174, compositions comprising, for example aluminum, copper, ferric oxide ($Fe_2O_3$) and Teflon are disclosed. These compositions, while liberating a large amount of heat have the disadvantage of generating gas which causes an increase in pressure.

Some pyrotechnic compositions include an oxidizer in addition to air in order to increase the rate of the oxidation reaction. In U.S. Pat. No. 3,890,174, e.g., the fluorocarbon is used as an oxidizer.

A composition which has been considered for pyrotechnic uses comprises gypsum ($CaSO_4.2H_2O$), aluminum, and water. But due to its unreliability, sometimes burning too slowly and other times detonating, this composition has not been adopted. The advantages of this composition are several: inexpensive materials, simple processing, and extremely high heats of reaction. If the reliability of this composition could be improved or a composition with similar but more reliable materials could be formulated, the composition would be an excellent pyrotechnic composition for metal-cutting applications, such as ordnance demilitarization.

SUMMARY OF THE INVENTION

It is, therefore, an object of this invention to provide a high-temperature, low-gas-volume pyrotechnic composition prepared from inexpensive and readily available materials.

Another object of the present invention is to dry-process a pyrotechnic composition to a hard durable mass.

And another object of the present invention is to provide a pyrotechnic composition with a long shelf-life and predictable performance.

A further object of the present invention is to demilitarize ordnance cheaply and safely.

These and other objects accomplished by the simultaneous reactions of a metal such aluminum with oxygen released by the decomposition of anhydrous calcium sulfate, calcium sulfate hemihydrate, anhydrous strontium sulfate, anhydrous magnesium sulfate, magnesium monohydrate, or a mixture thereof; a metal, such as aluminum with a halogen released by the decomposition of a halogenated hydrocarbon binder, and the reactions of sulfur and oxygen with iron in the work piece.

DETAILED DESCRIPTION OF THE INVENTION

Broadly, the present pyrotechnic composition comprises, based on percent of total composition weight, an oxidizer selected from the class consisting of calcium sulfate hemihydrate anhydrous calcium sulfate, anhydrous strontium sulfate, anhydrous magnesium sulfate, magnesium monohydrate, and mixtures thereof, a metal fuel selected from the class consisting of aluminum, magnesium, alloys of aluminum and magnesium, and mixtures thereof, a binder comprising a halopolymer, and optionally a combustion promotor comprising sulfur.

The oxygen from the oxidizer reacts primarily with the metal fuel, secondarily with any carbon or hydrogen present in the composition, and with the work piece. Consequently, the best compositions have an excess of oxidizer; however, metal-cutting pyrotechnic compositions can be formulated with an oxidizer content from about 20 to 80 weight percent. Preferably the oxidizer is present in an amount from 40 to 65 weight percent. The particle size of the oxidizer can be as large as a thousand microns but preferably the particle size is from 10 to 50 microns.

It is the oxidation of the metal fuel which produces the predominant amount of heat from the composition. It is preferred that all of the metal fuel is not oxidized; so that, some of the metal fuel melts and comes into contact with the work piece, thereby establishing, an excellent heat contact with the work piece. The metal fuel is present in an amount from about 15 to 70 weight percent and preferably from 30 to 55 weight percent. The particle size of the metal fuel can be as high as 200 microns, but preferably the particle size is from 40 to 50 microns.

The binder serves two purposes: to bind the ingredients together, so that, they form a mass with good mechanical strength and to provide a second source of oxidizer. Halogenated polymers are capable of meeting both requirements with fluoronated polymers being the best. Examples of suitable fluorinated polymers are polytetrafluoethylene (Teflon), perfluoropolypropylene, perfluorobutyl acrylate, and poly(chlorotrifluoroethylene), polyvinyl fluoride, polyvinylidene fluoride, copolymers of tetrafluoroethylene and perfluoropropylene and polyperfluorobutadiene. The binder is present in a amount sufficient to hold the composition together and to withstand the mechanical stresses of combustion. Generally the amount is from about 2 to about 15 weight percent and the preferred amount of binder is from 5 to 10 weight percent.

Sulfur is a combustion promoter; in that, it exothermically reacts with iron. Its addition is not required, but it can be added in an amount from about 0 to 10 weight percent and preferably from 2 to 5 weight percent. The particle size of sulfur can be as high as 40 microns but preferably is less than 20 microns.

Preparation of the pyrotechnic compositions of the present invention comprises simply adding the ingredients together, mixing them until a uniform mixture is obtained, and pressing the composition into a solidified mass. A tumble mixer, drum mixer, or other suitable means including manual mixing can be used to mix the ingredients together. It is important that the atmosphere is reasonably free of moisture and that no water is introduced into the processing.

If the composition is to be used in a pyrotechnic torch the composition is generally pressed to form discs or a solid cylinder or a cylinder with a hollowed portion extending approximately 50% of its actual length. The discs are stacked and bonded together to form a cylindrical configuration. The resulting cylinder is bored the total length of the cylinder. The charge is then placed into a pyrotechnic torch and bonded to the sides of the pyrotechnic torch. The bonding to the sides of the torch is of a degree sufficient to inhibit burning on the outside of the charge. If burning occurs on the outside of the charge, the chance of an unwanted detonation is increased considerably. The hollowed center is filled with an ignition powder, such as, a thermic powder. Any powder which is capable of producing a temperature in excess of 250 C. can be used so long as little gas is produced. The ignition powder is generally held in place by aluminum foil discs or similar restraint means. A squib is then attached to the ignition powder by, for example, adhesives. An example of a possible cutting torch is shown in U.S. Pat. No. 3,713,636 by Helms et al., issued on Jan. 30, 1973.

The invention, having been described in general, is now illustrated by the following examples. It is understood that the examples are given by way of illustration and are not meant to limit this disclosure or the claims to follow in any manner.

EXAMPLE I

A pyrotechnic composition was prepared by adding to a tumble mixer, 930 grams of calcium sulfate hemihydrate, 930 grams of aluminum (Alcoa 120), 100 grams of Teflon 7-C (35 microns), and 40 grams of sulfur (sublimed flower). The ingredients were mixed for 45 min. An approximately 265 gram portion was removed and placed in a hydraulic press and was pressed at 10,000 psi with a press dwell time at maximum pressure of 60 seconds. Five additional portions were removed and processed.

The discs were tested for their burning times and for the temperature and maximum temperature generated. The burning times averaged approximately 4 seconds with a variation of plus or minus one second. The maximum temperature obtained was approximately 3000 C.

EXAMPLE II

The composition of EXAMPLE I was duplicated and the six discs were assembled in a cutting torch. The cutting torch was able to cut through a work piece made from the one-half inch steel plates.

EXAMPLE III

A metal-cutting pyrotechnic charge was prepared by the method of EXAMPLE I and comprised calcium sulfate hemihydrate (45%), powdered aluminum (45%), Teflon (5%), and sulfur (5%). The total mass was 1315 g with a density of 1.82 g/ml. The cutting rate for a one-half inch steel plate was about five percent faster than the rate for the composition of EXAMPLE II.

The formulations, being pressed instead of cast, had little or no water and as such no lengthy drying procedures were necessary or additional precedures to precisely control the amount of water were necessary. Consequently, mass production of the present pyrotechnic compositions would be cheaper than cast compositions.

Further experimentation has shown that formulations with little or no water are the most stable and do not degrade on storage. The pressing procedure delivers nonporous grains of high density, whereas porous grains of lower density result from water casting procedures. Voids in a burning pyrotechnic composition can cause detonation. The greater density improves the reproducibility of burning and cutting thickness of the grains. The complete lack of hydrogen and the almost absence of carbon give a pyrotechnic composition with little gas-producing capability.

Many obvious modifications and embodiments of the specific invention, other than those set forth above, will readily come to mind to one skilled in the art having the benefit of the teachings presented in the foregoing description. Hence, it is to be understood that such modifications are included within the scope of the appended claims.

What is claimed as new and secured by Letters Patent of the United States is:

1. A pyrotechnic composition suitable for metal cutting which, based on total composition weight, comprises:

an oxidizer selected from the class consisting of calcium sulfate hemihydrate, anhydrous calcium sulfate, magnesium monohydrate, anhydrous magnesium sulfate, anhydrous strontium sulfate, and mixtures thereof in an amount from about 20 to 80 weight percent;

a metal fuel selected from the class consisting aluminum, magnesium, alloys of aluminum and magnesium, and mixtures thereof in an amount from about 15 to 70 weight percent;

a binder comprising a halopolymer in an amount from about 2 to 15 weight percent; and a combustion promoter comprising sulfur in an amount from about 0 to 10 weight percent.

2. The composition of claim 1 wherein said oxidizer is present in an amount from about 40 to 65 weight percent.

3. The composition of claim 1 wherein said metal fuel is present in an amount from 30 to 55 weight percent.

4. The composition of claim 3 wherein said metal fuel is aluminum.

5. The composition of claim 2 wherein said metal fuel is from 30 to 55 weight percent and sulfur is from 2 to 5 weight percent.

6. The composition of claim 5 wherein said metal fuel is aluminum.

7. The composition of claim 2 wherein said binder is from 5 to 10 weight percent.

8. The composition of claim 5 wherein said binder is from 5 to 10 weight percent.

9. The composition of claim 2 wherein said binder is a fluorinated polymer.

10. The composition of claim 3 wherein said binder is a fluorinated polymer.

11. The composition of claim 8 wherein said binder is a fluornated polymer.

12. The composition of claim 9 wherein said binder is polytetrafluoethylene.

13. The composition of claim 10 wherein said binder is polytetrafluoethylene.

14. The composition of claim 11 wherein said binder is polytetrafluoethylene.

* * * * *